United States Patent [19]

Hunwick

[11] 3,967,778

[45] July 6, 1976

[54] CENTRIFUGAL SEPARATOR

[75] Inventor: Richard James Hunwick, Wollstonecraft, Australia

[73] Assignee: Dorr-Oliver Incorporated, Stamford, Conn.

[22] Filed: Apr. 14, 1975

[21] Appl. No.: 567,523

[30] Foreign Application Priority Data

Apr. 23, 1974 Australia ..... 7339/74

[52] U.S. Cl. ..... 233/7; 233/14 R

[51] Int. Cl.[2] ..... B04B 1/20

[58] Field of Search ..... 233/7, 1 D, 14 R, 14 A

[56] References Cited

UNITED STATES PATENTS

| | | | |
|---|---|---|---|
| 3,228,594 | 1/1966 | Amero | 233/7 |
| 3,279,687 | 10/1966 | Amero | 233/7 |
| 3,348,767 | 10/1967 | Ferney | 233/7 |
| 3,423,015 | 1/1969 | O'Conor | 233/7 |
| 3,854,658 | 12/1974 | Probstmeyer | 233/7 |

*Primary Examiner*—George H. Krizmanich

*Attorney, Agent, or Firm*—Burtsell J. Kearns; Harold M. Snyder

[57] ABSTRACT

A centrifugal separator having a bowl and means to rotate the bowl about a longitudinal axis, the bowl including a cylindrical section and a coextensive conical section whereby, in use, a bath of feed material will form partially up the conical section as the bowl rotates with the remainder of the conical section forming a beach area up which separated solids are conveyed by a screw conveyor adapted to collect separated solids from adjacent the inside wall of the bowl and convey them out of the bath and up the beach to an outlet from the bowl, with weir means in the form of an overflow passage to allow substantially solid free liquid to be removed from the bowl, a first conduit extending into the bowl through one end thereof and coincident with the rotation axis thereof, and one, or more second conduits within and coaxial with respect to the first conduit and each other to define an inner passage and at least one outer annular passage through which feed material, and at least one separate treatment material may be delivered into the bowl.

3 Claims, 6 Drawing Figures

CENTRIFUGAL SEPARATOR

Figure 1:
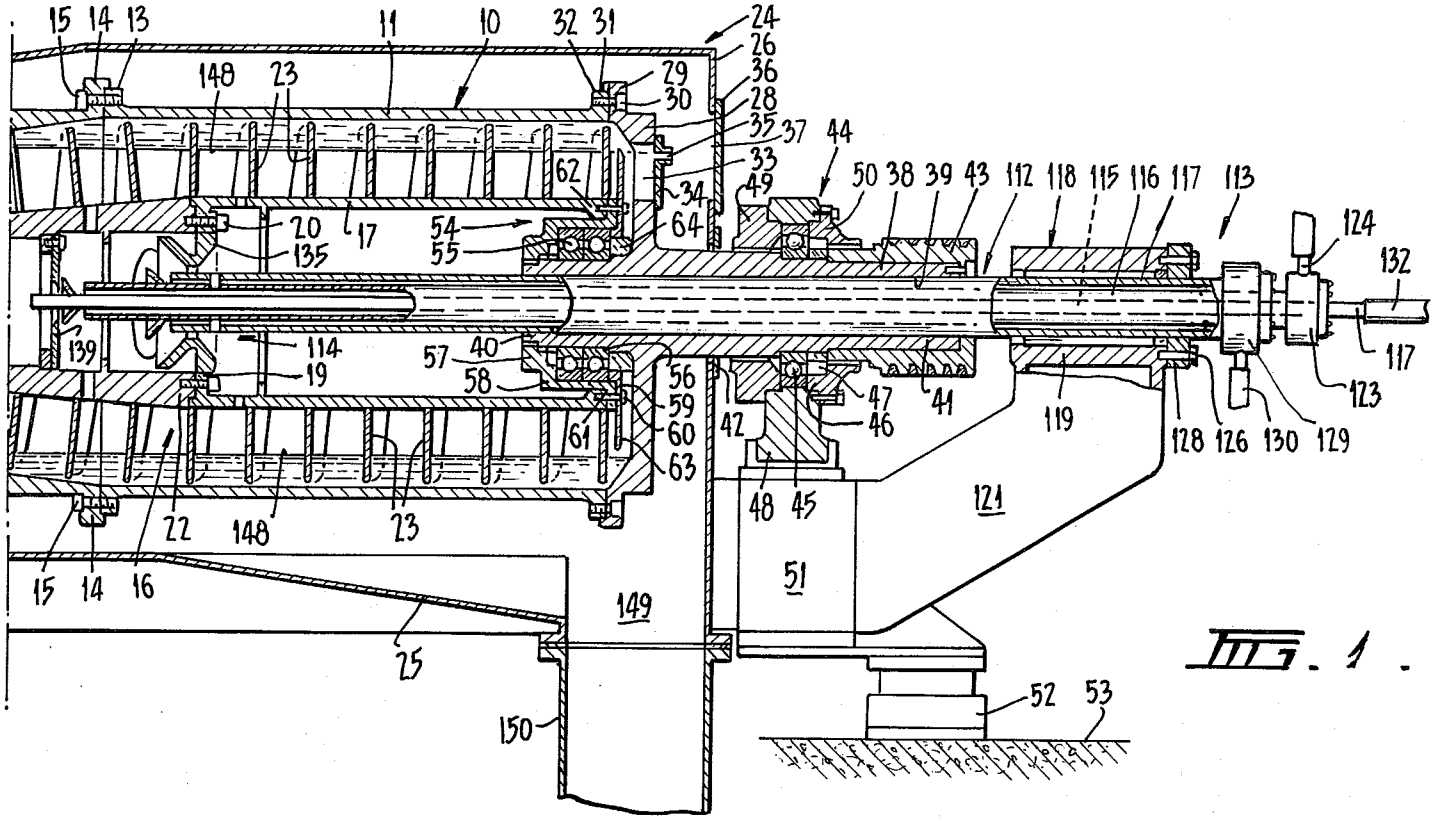

This invention concerns improvements in, or relating to, centrifugal separators, and more particularly centrifugal separators for processing material where the addition of treatment materials to the feed in the separator is required.

The invention particularly, but not exclusively, relates to centrifugal separators in which treatment material such as flocculent, or wash water, or both, are added.

The inventive centrifugal separator is also particularly applicable, but not limited to, use in the treatment of raw sugar juice. However, the inventive centrifugal separator may be utilised in the processing of any material where the material in the separator requires the addition of treatment materials such as flocculent and/or wash water.

One known form of centrifugal separator over which the present invention represents an improvement, is disclosed in U.S. Pat. No. 3,501,346 in which a centrifugal separator is disclosed and performs an important step in the treatment of sugar mill clarifier mud as outlined in that specification.

The improved centrifugal separator of the present invention is also applicable to use in the system described in a copending Australian Patent Application entitled "Treatment of Raw Sugar Juice" and lodged by us on 17th Apr., 1974, under No. PB 7275.

As previously mentioned the improved centrifugal separator of the present invention is applicable, but not restricted, to utilisation in processes for the treatment of raw sugar juice.

In the production of raw sugar, raw sugar juice is obtained from the sugar cane by cutting the cane and crushing it to obtain raw sugar juice and sugar cane residue known as bagasse.

The raw sugar juice is then purified, concentrated by evaporation and then crystallised to obtain raw cane sugar and molasses as the final product. The raw sugar cane is generally then processed by a sugar refining process to obtain white sugar.

The raw sugar juice obtained by crushing of the sugar cane is turbid and discoloured and contains large amount of dirt or mud which is usually present in the sugar as harvested, together with other solids such as fibrous and pith or corky material. Clarification of the raw sugar juice is accomplished by liming, heating and settling to separate as much as ppssible of the insoluble suspended and colloidal solids from the juice prior to the evaporation process.

It is common practice to perform the separation step after the liming and heating steps by using sedimentation chambers in a conventional commercial clarifier. The clarifier overflow comprises a clear juice or liquor which is removed from the top of the clarifier and sent to the evaporators. The remaining liquid suspension of high solid contents is drawn from the bottom of the clarifier and is normally referred to as clarifier mud. In addition to dirt, fibrous and pith or corky material the clarifier mud may also contain other solids such as insoluble salts, natural gums and resins which have been precipitated and coagulated during the precluding liming and heating step.

Clarifier mud is usually removed from the clarifier in large quantities and has a relatively high sugar content making it economically desirable to process the mud and recover as much of the sugar content as possible.

The processing of the clarifier mud has been carried out by filtration and filter press or preferably a rotary vacuum filter.

It has been found that even under the most favourable circumstances the filtration of clarifier mud is a difficult and inefficient operation subject to many disadvantages such as difficulty in disposing of the filter cake, absorption of substantial part of the sugar juice in the filter cake, the necessity to recycle to adequately filter which subjects the sugar content to prolonged exposure to high temperatures and the tendency for the wax component of the filter cake to pass into the recycled filtrate and complicate subsequent evaporation and crystallization operations being fed by the clarifier.

It has been previously proposed that the clarifier mud be subjected to a process of centrifugal separation instead of filtration to overcome the above problems with filtration, and one such centrifugal separating process is described in U.S. Pat. No. 3,501,346 in which a process is disclosed involving treating clarifier mud from a clarification operation under controlled temperature, pH and flocculent addition conditions in a continuous bowl centrifugal separator to separate and recover the sugar juice with a minimum of suspended solids content. The separated thickened mud cake is then subjected to one or more counter current washing operations with water to recover the major part of the sugar content of the mud cake, the washing being combined with recovered clarified sugar juice from a first stage separation.

The applicant's improved process and system for the treatment of raw sugar juice as disclosed in the copending Australian Patent Application entitled "Treatment of Raw Sugar Juice" involved a similar type of system, except that in the improved processing system provision is made for the removal of fine grits or dirt from the clarifier mud prior to being fed to the centrifugal separators in order to reduce as much as possible of the undesirable grit or dirt so that the clarifier mud drawn from the bottom of the clarifier for treatment in the centrifugal separators is substantially free of wear inducing and erroding dirt or grit.

In both the processes described in U.S. Pat. No. 3,501,346, and the applicant's copending Australian application, flocculent is added to the clarifier mud being delivered to the centrifugal separators. The flocculent added may comprise any suitable material for the purpose for which many commercially available ones are well known to those skilled in the art and several such suitable flocculents are discussed in U.S. Pat. No. 3,501,346. The primary reason for the addition of flocculent is to coagulate the fine materials in the clarifier mud to enable those materials to be satisfactorily separated from the sugar juice in the centrifugal separator. In U.S. Pat. No. 3,501,346, the flocculent is added to the clarifier mud feed fed to the centrifugal separators, and thus is already present and performing its function before actually being delivered into the centrifugal separator. This may also be the case with the improved method, and system of the applicant's copending application, although as described in the copending application the improved centrifugal separator of the present invention may be employed for the advantages it offers in such treatments.

The major problem associated with adding flocculent to the clarifier mud prior to being fed into the centrifugal separator, is that some of the desired effect of the flocculent, that is, coagulation of the fine solid materiais is lost. In the centrifugal separator the material fed thereto is flung, under the action of centrifugal forces, against the circumferential inside wall of the bowl or housing of the separator, with the solid material thereby settling closer to the wall to be collected and conveyed by a helical screw conveyor from the separator, whilst the remaining substantially solid free liquid flows over a weir arrangement to be thereafter removed from the separator. With known separators where the flocculent is already added to the clarifier mud being fed to the separator, much of the solid material has coagulated prior to being delivered to the interior of the separator and the centrifugal forces then applied cause the particles of coagulated material to impinge at relatively high speed on the inside wall of the centrifugal separator or the surface of the liquid bath therein, thus tending to disintegrate the coagulated particles rather than hold them intact to facilitate effective separation of the solids in the separator.

It is therefor an object of the present invention to provide an improved centrifugal separator including a facility to substantially overcome the above problem with treatments in conventional centrifugal separators.

The invention basically provides means for delivering treatment material, such as flocculent, separately from the main feed to the centrifugal separator. With such separate means for delivering the flocculent, the flocculent may therefore be delivered to the bath in the centrifugal separator after the material therein has been brought up to speed.

It is also desirable in some situations to subject the solids being separated in the centrifugal separator to a washing operation.

It is therefor a further object of the present invention to provide an improved centrifugal separator having facility for feeding wash water into the separator separately from the main feed and bring it into contact with the solids being separated therein, prior to their removal from the separator.

In this respect it has been found that delivery of wash water at a point where it contacts the solids as they are being moved up the beach section of the separator by the helical screw conveyor tends to cause much of the fine solids to be washed back into the bath in the separator, whilst if delivered at a point within the main body of the bath in the separator, the wash water is substantially ineffective and merely has a diluting effect on the material in the bath in the separator. The applicant has found that the delivery of wash water to a point close to the tide line of the bath in the separator, that is, substantially close to the transition zone between the bath and the beach, enables the wash water to perform its function in the most efficient manner.

The invention therefor envisages a centrifugal separator having a bowl and means to rotate said bowl about a longitudinal axis, means allowing feed material to be delivered into said bowl, said bowl including a substantially conical section such that when in use a bath of feed material will form partially up said conical section as said bowl rotates with the remainder of said conical section forming a beach area up which separated solids are conveyed by a conveyor means adapted to collect separated solid from adjacent the inside wall of the bowl and convey them out of said bath and up said beach to an outlet from said bowl, and means to allow substantially solid free liquid to be removed from said bowl, wherein means are also provided to deliver treatment material to said bath independently of the main feed material.

Preferably the means to deliver feed material is a first feed conduit extending into said bowl through one end thereof and coincident with the rotation axis thereof.

Preferably the means to deliver treatment material is at least one second feed conduit extending into said bowl at said one end thereof and substantially coaxial with respect to said first feed conduit.

Preferably where two or more treatment materials are being added a series of second feed conduits are provided coaxial with respect to the first feed conduit and each other.

Preferably the second feed conduit is within said first feed conduit and provides an inner passage for treatment material and an outer annular passage formed between the conduits for the feed material.

Preferably where two treatment materials are being added the further second feed conduit is within the first of the second feed conduits and provides an annular passage between the first of the second feed conduits and itself through which the first treatment material is delivered with the second treatment material being delivered through the further second feed conduit.

Preferably where the treatment material being added is flocculent, the exit from the second feed conduit therefor terminates in a transverse plane passing through the bath.

Preferably where the treatment material being added is wash water, the exit for the second feed conduit therefor, lies in a transverse plane substantially coincident with the transition zone between the bath and the beach sections of said bowl.

Preferably said bowl also includes a substantially cylindrical section coextensive with said conical section with the bath forming around the substantially cylindrical section and partially up said conical section.

Figure 2:
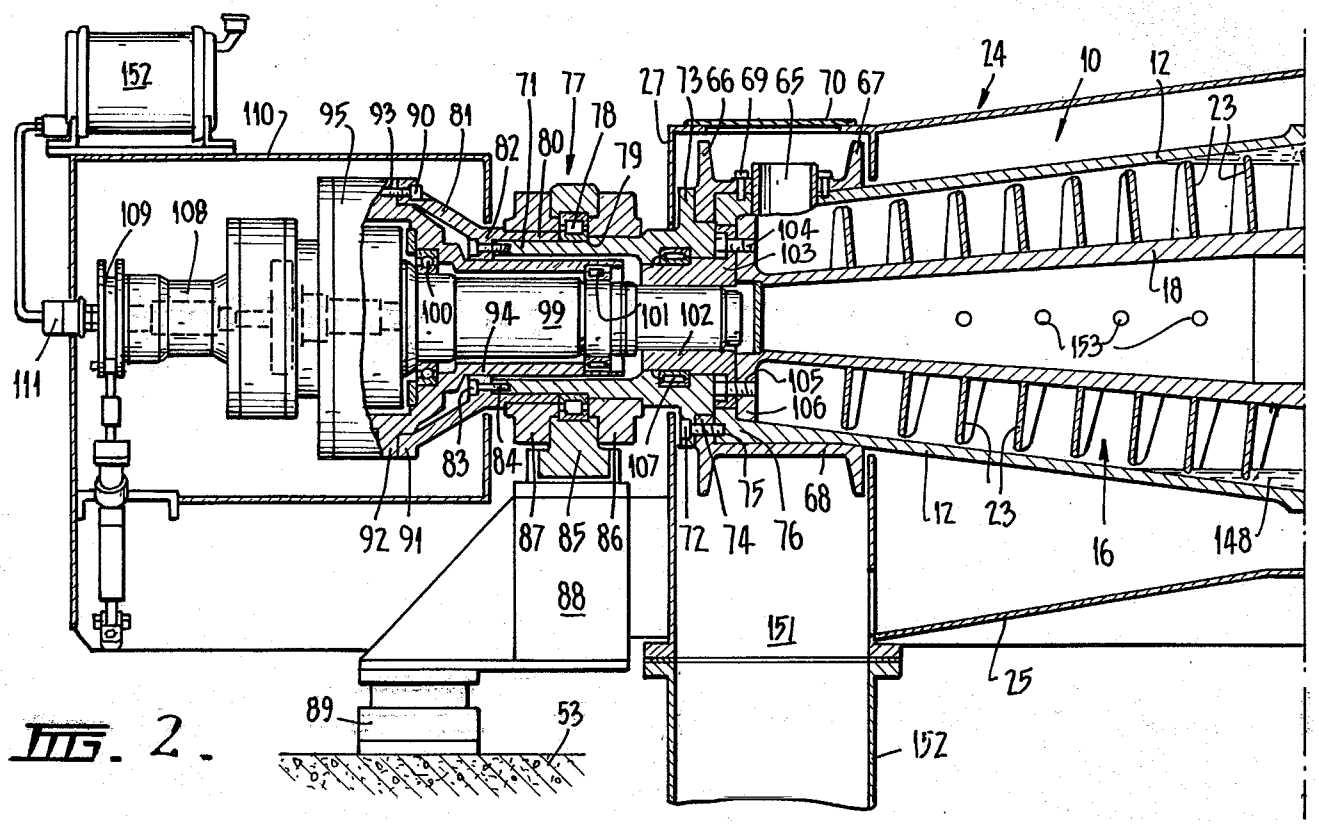
Figure 3:
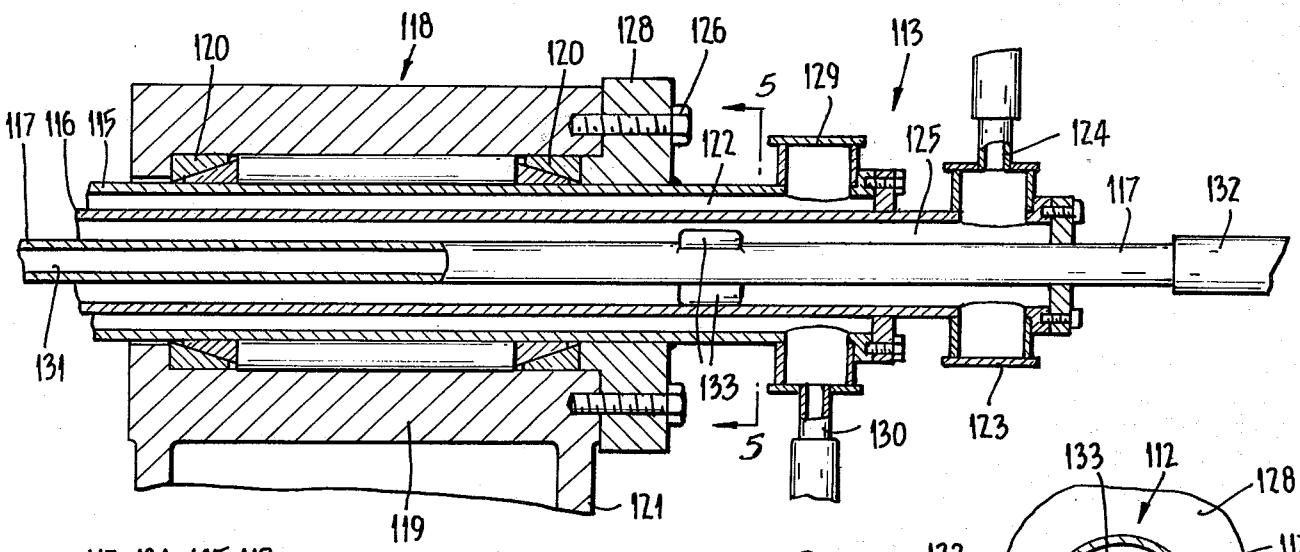
Figure 5:
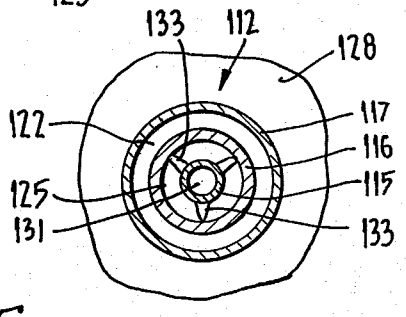
Figure 6:
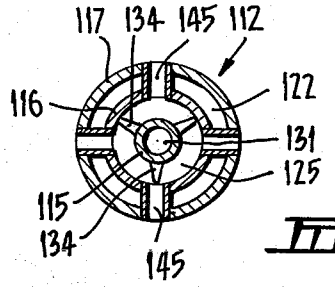
Figure 4:
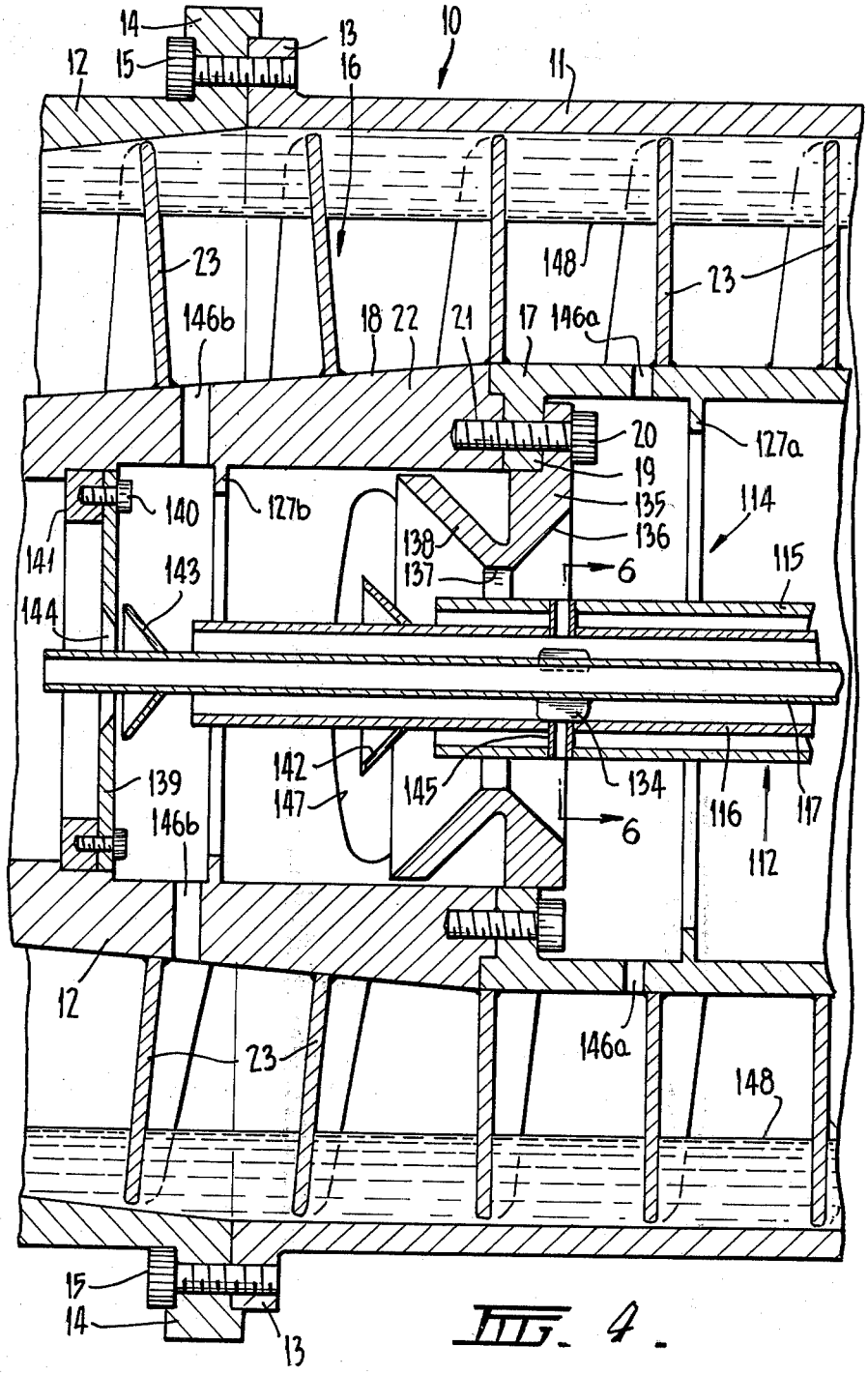

One preferred form of the invention will now be described with reference to the accompanying drawings in which:

FIG. 1 represents a longitudinal cross-sectional view of the input end of a continuous solid bowl centrifugal separator incorporating the present invention;

FIG. 2 is a longitudinal cross-sectional view of the output end of the centrifugal separator of FIG. 1, FIG. 3 is a detailed cross-sectional view of the arrangement of the inlets for the feed conduits for the input end of the centrifugal separator of FIG. 1, FIG. 4 is a detailed cross-sectional view of the arrangement of the outlets for the feed conduits within the centrifugal separator of FIG. 1, FIG. 5 is a transverse sectional view taken along line 5—5 of FIG. 3, and FIG. 6 is a transverse sectional view taken along line 6—6 of FIG. 4.

With reference to FIGS. 1 and 2, the centrifugal separator comprises an imperforate or solid tubular bowl or housing designated generally at 10 and having a uniform diameter cylindrical section 11 toward the input end of the separator and a tapered or conical section 12 at the opposite or output end, the two sections 11 and 12 being made separately from each other and provided each with a flange 13 and 14 respectively at their adjacent ends through which circumferentially spaced attachment bolts 15 are received to join the two sections together. A screw conveyor, indicated generally at 16, is provided coaxially within the bowl 10 and comprises a cylindrical tubular section 17 with a tapered end section 18. The two screw conveyor sections 17 and 18 are made separately from each other and the cylindrical section 17 is provided with an internal flange 19 through which circumferentially spaced attachment bolts 20 are received for cooperation with threaded holes 21 correspondingly circumferentially spaced in the adjacent end 22 of thickened cross-section for the tapered end section 18 to facilitate attachment of the two sections together. A helical screw conveyor element 23 extends around the exterior of both sections of the screw conveyor 16. Both the bowl 10 and the screw conveyor 16 are supported for rotation about a common horizontal axis passing through a housing or machine base generally indicated as 24 having a circumferential wall 25 surrounding and spaced from the bowl 10 and an end wall 26 adjacent the input end of the separator and an end wall 27 adjacent the output end of the separator to form the complete housing 24.

The input end of the bowl 109 is closed by an end plate assembly 28 having a circumferential flange 29 through holes in which circumferentially spaced connecting bolts 30 pass to be received in correspondingly threaded holes 31 in a mating flange 32 formed on, and circumferentially surrounding, the input end of the bowl 10 to facilitate attachment of the end plate assembly 28 and to bowl 10.

An overflow port 33 is provided through the end plate assembly 28 and has an output overflow disc 34 clamped or otherwise attached about the outer end of the overflow port 33, which overflow disc 34 includes therethrough an overflow passage 35. The distance between the radially outermost point of the overflow passage 35 and the inner wall of the cylindrical section 11 of the bowl 10 determines the depth of the bath in the separator during rotation of the bowl. As shown in FIG. 1, the outlet overflow disc 34, and therefor the overflow passage 35, is set for a minimum bath depth, and by rotating the orientation of the disc 34 to effectively move the outlet passage 35 closer to the rotation axis of the bowl, or by merely substituting the disc and passage combination 34, 35 with an alternative combination with a passage 35 effectively spaced closer to the rotation axis of the bowl 10, the depth of the bath can be increased to whatever predetermined value is required. The adjustment of the orientation of the disc 34, or the substitution of an alternative disc, may be facilitated through a cover hatch 36 attached by wing bolts, or like attachment means, over an access opening 37 in the end wall 26 of the housing 24.

The radially innermost portion of the end plate assembly 28 has attached thereto, or formed integrally therewith as is particularly shown in FIG. 1, a drive shaft 38 having an axial passage 39 therethrough of circular cross-section and having a portion 40 extending away on one side of the plate assembly 28 internally of the bowl 10 and a portion 41 of generally larger length extending away on the other or input side of the plate assembly 28 through an opening 42 in the end wall 26 of the housing 24 to terminate externally of the input end of the housing. The extreme end section of the portion 41 carries a drive pulley 43 bolted, keyed or otherwise attached to the drive shaft 38. The drive pulley may be driven by a V-belt drive arrangement from an electric motor (not shown) to thereby rotate the drive shaft 38 and therefor, the bowl 10 via the end plate assembly 28, at a predetermined rotational speed.

As is particularly shown in FIG. 1, the input end of the bowl is supported in the housing by a drive and support arrangement generally indicated as 44 supporting the portion 41 of the drive shaft 38 extending externally of the input end wall 26 of the housing 24. The drive and support arrangement 44 includes a drive end main bearing 45 axially force fitted about the drive shaft 38 and again stay step 46 formed on the external surface of the shaft and held in position by lock nut and washer arrangement 47. A bearing support housing 48 surrounds the drive end main bearing 45 and two end covers 49 and 50 fixed to the drive shaft 38 and the drive pulley 43 respectively complete the drive end support arrangement 44. The gearing support housing 48 is in turn supported on a main base frame 51 which in turn is supported on a footing 51 attached to and resting on a floor 53 for the installation.

The input end of the screw conveyor 16 is internally supported at the input end of the cylindrical section 17 thereof about the inner portion 40 of the drive shaft 38 to be freely rotatable about and relatively thereto by means of a drive end screw conveyor support bearing arrangement generally indicated as 54 in FIG. 1 comprising a bearing 55 axially force fitted about the portion 40 of the drive shaft 38 and against a step 56 formed on the external surface of the portion 40 and held in place by a lock nut and washer arrangement 57 and retained within a bearing housing 58 having a flange portion 59 through which circumferentially spaced attachment bolts 60 pass into correspondingly threaded holes 61 in an internal boss 62 at the end of the cylindrical section 17 of the screw conveyor 16. The same bolts 60 also facilitate attachment of a flotation disc 63, whilst a bearing end cover 64 completes the arrangement 54.

With reference to FIG. 2 of the drawings, the wall of the output end of the bowl 10 at the extreme end of the tapered section 12 has a solids discharge passage 65 extending radially outwardly through to exit into a passage between two radially extending flanges 66 and 67 of a solids ejector member 68, which in turn is attached by bolts 69 to the end of the bowl 10. At the solids ejector section of the separator the housing 24 is provided with a removable inspection hatch cover 70 to allow for inspection and cleaning of this section of the separator.

A hollow transmission input shaft 71 is attached to one end of the bowl 10 and attachment is facilitated by bolts 72 passing through a flange 73 formed integrally with and circumferentially surrounding the end of the transmission input shafts 71 adjacent the bowl 10, and receives through aligned holes in a radially inwardly extending flange 74 for the solids ejector member 68 and subsequently received in correspondingly threaded holes 75 in a thickened boss section 76 for the end of the bowl 10.

The transmission input shaft 71, and therefor the output end of the bowl 10, is supported for rotation at the output end of the separator by a support arrangement generally indicated as 77 in FIG. 2, which includes the main bearing 78 axially force fitted about the transmission input shaft 71 and against a step 79 formed around the external surface of the shaft 71 and held in place by an axially extending sleeve section 80 of a gear housing flange 81 which in turn carries an inwardly directed flange 82 integrally formed therewith and through which circumferentially spaced attachment bolts 83 pass to be received in correspondingly threaded holes 84 in the end of the transmission input shaft 71.

A main bearing support housing 85 supports the bearing 78 and inner and outer bearing covers 86 and 87 complete the arrangement 77. The bearing support housing 85 is in turn supported on a main base frame 88 which in turn is supported on a footing 89 attached to, and resting on, the floor 53 of the installation.

The gear housing flange 81 is attached to a gear housing 92 by circumferentially spaced bolts 90 passing through an outer flange 91 on the gear housing flange 81 and into correspondingly threaded holes 93 in the gear housing 92. The gear housing 92 has an axial extension sleeve 94 formed integrally therewith which extends into the interior of the transmission input shaft 71. The gear housing 92 forms part of a conventional cyclo-geared reduction unit 95 for example of the type manufactured by SUMITOMO SHIPBUILDING AND MACHINERY CORP. under name SM CYCLO-DRIVE. The output shaft 99 of the cyclo-geared reduction unit 95 extends through the axially extending sleeve 94 of the surrounding gear housing 92 and is supported for rotation therein and relative thereto by a spaced pair of transmission of output shaft bearings 100 and 101.

The end of the transmission output shaft 99 remote from the gear transmission is keyed to a screw conveyor hub 102 carrying an end flange 103 through which circumferentially spaced bolts 104 pass to be received within correspondingly threaded holes 105 through an end flange 106 on the output end of the screw conveyor 16 to facilitate attachment thereto, and therefor to allow the transmission output shaft 99 to drivingly rotate the screw conveyor. The hub 102 is supported within the transmission input shaft 71 to rotate within and relative thereto by a needle bearing 107. The reduction unit 95 is such as to provide a transmission ratio between the input from the bowl 10 and the output to the screw conveyor 16 to provide a speed differential between the bowl 10 and the screw conveyor 16 although maintaining the same direction of rotation for both.

Normally the screw conveyor speed is approximately 1 percent slower than the bowl rotational speed, and for a bowl speed of 3000 rpm the screw conveyor speed may be in the order of 25 rpm slower. All that is required is that some speed differential exist to maintain relative movement of the screw conveyor 16 relative to the bowl for the purposes of conveying solid materials flung to the inner surface of the bowl toward the output end of the separator.

The reduction unit of the separator is generally conventional for separators to achieve the purpose explained above, and as is sometimes utilised in conventional transmissions the transmission is linked via a drive assembly 108 to an overload disc clutch arrangement generally shown in FIG. 2 as 109 which cooperates with an output shaft through the drive assembly 108 and normally holds that shaft stationary. If the transmission for the separator is overloaded the overload disc clutch is actuated to release the normally stationary shaft in the drive assembly 108 to free the gear box.

A supply of lubricating oil is maintained within the gear transmission from an oil reservoir 152 situated on top of a housing 110, enclosing the gear transmission and the overload transmission, via a rotary fluid sealing unit 111.

In accordance with one preferred form of the invention, provision is made to deliver treatment material to the bath in the bowl 10 of the separator independently of the main feed for the material to be subjected to centrifugal separation, and in this preferred embodiment is accomplished by an arrangement generally indicated as 112 of coaxial conduits the common longitudinal axes of which are coincident with the axis of rotation of the separator. The arrangement 112 has an input end generally indicated as 113 and more particularly disclosed in FIGS. 3 and 5, and an output end generally indicated as 114 and more particularly disclosed with reference to FIGS. 4 and 6.

The arrangement 112 of coaxial conduits comprises an outer conduit 115, an intermediate conduit 116 and an inner conduit 117, extending from outside the input end of the separator and through the axial passage 39 through the drive shaft 38 for the end plate assembly 28 for the bowl, and terminate at spaced points within the interior of the screw conveyor 13 at approximately the transition zone between the cylindrical section 11 and the tapered or conical section 12 of the screw conveyor.

The arrangement 112 is supported in the axial passage 39 through the drive shaft 38 as well as by an external support structure 118 beyond the drive pulley end of the drive shaft 38. The external support structure 118 includes a sleeve member 119 surrounding the arrangement 112 at this point with tapered inner locating ring arrangements 120 interposed between the sleeve member 119 and the external circumferential surface of the outer conduit 115 of the arrangement 112. The sleeve member is formed integrally on the end of a cantilever support structure 121 which in turn is supported from the main frame 51. A collar member 128 surrounds the arrangement 112 adjacent the external support structure 118 and is attached thereto by circumferentially spaced bolts 126.

The conduit arrangement 112 is designed to allow delivery of feed material to be subjected to a separation process and two additive materials, such as, wash water for the separator, an flocculent to assist in coagulation of fine solid materials in the feed for the separator in the separator.

With reference to FIG. 3, the outer conduit 115 terminates at the input end at a length shorter than the intermediate conduit 116 and the annular passage 122 provided between the intermediate and outer conduits 116 and 115 provides a delivery passage for the feed.

The input end of the outer conduit 115 which terminates short of the end of the intermediate conduit terminates at a main feed cowling 129 into which a supply pipe 130 for the feed material is connected which material enters the cowling 129 and flows through the annular passage 122 provided between the outer conduit 115 and the intermediate conduit 116. The intermediate conduit 116 terminates at a flocculent feed cowling 123 into which a supply pipe 124 for flocculent additive from a flocculent preparation station (not shown) is connected which flocculent enters the cowling 123 and flows through an annular passage 125 provided between the intermediate conduit 116 and the inner conduit 117. The inner conduit 117 provides a delivery passage 131 for wash water for the separator and extends beyond the end of the cowling 123 for the flocculent supply where it is attached in fluid communication with a wash water supply conduit 132.

As is particularly shown in FIG. 5, the inner wash water conduit 117 has three radially outwardly extending support vanes 133 at the input end of the intermediate conduit 116 spaced at 120° intervals about the inner conduit 117 which vanes extend between the inner conduit 117 and the intermediate conduit 116 in the feed delivery passage 125 to retain the inner wash water delivery conduit 117 in coaxial relationship within the arrangement 112.

The output or delivery end of the conduit arrangement 112 is more particularly disclosed in FIG. 4 of the drawings and allows delivery of feed material, flocculent and wash water at specific points or compartments within the separator.

As particularly shown in FIG. 6, the inner wash water conduit 117 at the output or delivery end of the arrangement 112 has a further three radially outwardly extending vanes 134 spaced at 120° intervals about the inner conduit to assist in retaining the inner conduit 117 in coaxial relationship within the arrangement 112.

Within the screw conveyor 16 at a point adjacent the interconnection between the cylindrical section 17 and the tapered or conical section 18, a baffle member 135 is attached by virtue of the bolts 20 which hold the two sections together and provides an outwardly tapered surface 136 toward the input end of the separator merging with a short cylindrical section 137 leading to a further outwardly tapering surface 138 directed toward the output end of the separator. At a position spaced toward the output end of the separator a further baffle member in the form of a disc 139 is provided attached by bolts 140 to a radially inwardly directed flange 141 provided on the internal surface of the tapered or conical section 18 of the screw conveyor 16.

As shown in FIG. 4 the delivery end of the outer conduit 115 extends through the baffle member 135 and terminates within the confines of a compartment inteposed between the flocculent receiving compartments as delineated by the outwardly tapering surface 138 facing the output end of the separator and flange **127*b* intermediate conduit 116 has a conical baffle member 142 attached thereabout spaced from and in line with the opening from the outer feed passage 122 between the outer and intermediate conduits 115 and 116 to thereby deflect feed material issuing from the feed passage 122** radially outwardly within the separator.

The intermediate conduit 116 terminates short of the further baffle disc 139 and a conical baffle member 143 is provided about the inner conduit 117 between the baffle disc 139 and the opening for the annular feed passage 130 as shown so that flocculent issuing through the end of the flocculent passage 125 will be deflected radially outwardly within the separator.

The inner wash water delivery conduit passes through an opening 144 in the baffle disc 139 and terminates in the wash water compartment just on the output side of the baffle disc.

With particular reference to FIG. 6, radially extending tubes 145 are provided between the intermediate and outer conduits 116 and 115 to allow flow of flocculent from the flocculent delivery passage 125 outwardly of the conduit arrangement 112 at a point within the tapered section 136 of the baffle member 135 with the tapered surface 136 serving to direct the flocculent from those points axially back toward the input end of the separator.

Therefor, flocculent is delivered at two spaced positions or compartments within the separator, namely at the extreme end of the flocculent delivery passage 125 and between the baffle member 135 and the baffle disc 139 as well as on the input side of the baffle member 135.

In the operation of the separator the flocculent fed through the passage 125 and out through the end thereof as well as outwardly through the tubes 145 moves rearwardly to accumulate in an area between the baffle member 135 and a flange **127*a* extending circumferentially around the inner surface of the cylindrical section 17 of the screw conveyor 16 and then passes outwardly through the perforations 146*a* in the wall of the cylindrical section 17, and also, after deflection by baffle member 143, into an area between the baffle disc 139 and a flange 127*b* extending circumferentially around the inner surface of the tapered section 18 of the conveyor 16 and than passes outwardly through perforations 146*b* in the wall of the tapered section 18. The solids and liquid in the feed material fed through feed passage 122 is deflected by baffle member 142 and passes outwardly through a main transfer port 147 in the conical or tapered section 18 between the baffle member 135 and the baffle disc 139, to accumulate in an annular zone at the inner surface of the surrounding bowl. The depth of the pool of liquid as indicated at 148 is determined by the overflow passage 35 as previously discussed and can be altered in the manner previously discussed. The liquid overflow passes outwardly of the housing via output port 149 in communication with a liquid discharge conduit 150. Solids which are collected by the ends of the helical screw member 23 of the screw conveyor 16 are conveyed to the outlet end of the bowl at which point they pass, under centrifugal action, through the discharge passage 65 and out of the housing via the discharge port 151 in communication with a solids discharge conduit 152. In a typical separator of this type the depth of the liquid pool may range from ¼ inch to about 1¾ inches. For maximum clarification and removal of solids from the liquid discharged through the overflow passage 35 aa relatively deep pool 148 may be maintained which extends axially a substantial distance into the tapered section 12 of the bowl 10. However, if maximum dewatering and draining or drying of the solids discharged through the outlet 151 is desired, a relatively shallow pool 148 is maintained in the bowl which extends only slightly into the tapered section 12 of the bowl, thereby providing a maximum beach area in the tapered section. The solids which accumulate on the wall of the bowl in submerged relation in the liquid pool 148 are moved axially by the rotating screw conveyor 16 and are gradually displaced into the conical section 12 of the bowl where the solids are free of the liquid pool 148** and are drained by centrifugal action.

From the foregoing description of the operation of the continuous solid bowl centrifugal separator it will be understood that the separator, during operation, has distinct clarifying and drying zones as predetermined by the adjustment of the overflow passage 35 and the resultant depth of the liquid pool 148.

In this preferred embodiment the flocculent delivery passage 125 exits at spaced points or compartments situated near and adjacent to the delivery point for the main feed material. The flocculent feed is therefor not added to the main feed until well within the separator, and effectively does not commence to facilitate coagulation of the fine solid matter until it is delivered into the bath 148 in the separator.

Also in this preferred embodiment the wash water delivery passage 131 exits, and is transferred via wash water transfer passages 153 (see FIG. 2), to effectively be delivered at a point lying in a transverse plane substantially coinciding with the transition zone between the liquid bath 148 and the beach area provided by the tapered or conical section 12 of the bowl. With the wash water being delivered at this point, rather than further up the bowl area, or well within the bath or pool, the effectiveness of the wash water is at a maximum.

In a further modification the exits for the flocculent delivery passage 125 and the wash water delivery passage 131, or both, may be provided by outwardly radially extending pipe extensions to enable delivery of the flocculent and/or wash water closer to the inside surface of the bowl 10.

As stated previously the invention is particularly applicable in processes for the treatment of raw sugar juice, although it may be applied to other situations where the material being processed is required to be subjected to centrifugal separation and/or alternative treatment materials other than flocculent and/or wash water are being simultaneously supplied to the separator, and also situations where other treatment materials, are being added, requiring more than two coaxial treatment material feed passages.

I claim:

1. A solid bowl type centrifugal separator adapted to separate sugar juice from a sugar mud slurry feed and which separator comprises an external solid bowl member and means to rotate said bowl about a longitudinal axis, said bowl comprising a longitudinally extending cylindrical wide end portion and a conically constricted end portion extending from one end of said wide end portion such that when in use a bath of the sugar mud feed material will form partially up said conical section forming a beach area up which separated solids are conveyed by conveyor means adapted to collect separated solids from adjacent the inside wall of the bowl and convey them out of said bath and up the beach to an outlet from said bowl for said solids, and means provided at the opposite end of the wide end portion of the bowl to allow substantially solids free sugar liquid to be removed from said bowl, said conveyor means comprising an elongated hollow rotatable member arranged within said bowl and having a tubular section corresponding in length to said wide end portion of said bowl and having a tapered conical end portion arranged within said conical constricted portion of the bowl with screw conveyor means provided about the periphery of the outer surface of said member for transporting solids from the bath to the beach upon rotation thereof, a plurality of material receiving compartments provided at spaced preselected intervals along the length of said screw conveyor with said compartments having discharge openings in the surface of said conveyor means for discharging material to said bowl, a plurality of stationary conduit feed means extending into said rotatable hollow conveyor body and having outlets in open communication selectively with said material receiving compartments, said material receiving compartments comprising a pair of flocculent treatment material receiving chambers, a main feed material compartment for receiving the sugar mud slurry interposed between said flocculent treatment material compartments and a wash water compartment located within said constricted portion of said conveyor and said discharge opening for the sugar mud slurry open to the wide end bath portion of said separator bowl with the discharge openings from said flocculent compartments also open to the wide end bath portion at opposite sides of said sugar mud input opening, said discharge opening for the wash water compartment lying in a transverse plane substantially coincident with the transition zone between the bath and beach sections of said bowl to provide wash water at said transition point.

2. The centrifugal separator of claim 1 wherein said conduit feed means comprise a plurality of feed pipes arranged coaxially and as an assembly for removal as a unit from said conveyor body, and baffle means provided at spaced intervals along said assembly adjacent to the discharge outlets for controlling the directional flow of material discharged from said conduits.

3. The centrifugal separator of claim 1 wherein said wash water compartment and sugar mud feed compartment are provided with separate feed conduits and wherein said spaced flocculent receiving compartments are provided with a single supply conduit having discharge outlets located in each of said compartments.

* * * * *